US006446734B1

(12) United States Patent
Williams et al.

(10) Patent No.: US 6,446,734 B1
(45) Date of Patent: Sep. 10, 2002

(54) MOTOR/HANDLE HOUSING AND GEAR CASE MOUNTING FOR PORTABLE POWER TOOL

(75) Inventors: Robert B. Williams, Baltimore; Thomas J. Bodine, Jessup, both of MD (US); Todd A. Hagen, Windsor, PA (US)

(73) Assignee: Black & Decker Inc., Newark, DE (US)

( * ) Notice: Subject to any disclaimer, the term of this patent is extended or adjusted under 35 U.S.C. 154(b) by 165 days.

(21) Appl. No.: 09/628,827

(22) Filed: Jul. 31, 2000

Related U.S. Application Data

(60) Provisional application No. 60/164,899, filed on Nov. 11, 1999.

(51) Int. Cl.[7] ..... E21B 1/00

(52) U.S. Cl. ..... 173/1; 173/217; 173/213; 173/216

(58) Field of Search ..... 173/171, 213, 173/216, 217, 1; 310/47, 50

(56) References Cited

U.S. PATENT DOCUMENTS

| | | | | |
|---|---|---|---|---|
| 3,433,082 | A | 3/1969 | Bitter et al. | 74/22 |
| 3,908,129 | A | 9/1975 | Duncan, Jr. | 310/50 |
| 4,749,049 | A | 6/1988 | Greppmair | 173/162 |
| 5,033,550 | A | 7/1991 | Hu | |
| 5,149,230 | A | 9/1992 | Nett | 408/42 |
| 5,597,275 | A | 1/1997 | Hogan | 408/239 |
| 5,813,805 | A | 9/1998 | Kopras | 408/241 |

FOREIGN PATENT DOCUMENTS

| | | |
|---|---|---|
| DE | 3115280 C2 | 6/1985 |
| DE | 19812718 A1 | 9/1998 |
| EP | 0 561 223 B1 | 7/1995 |
| EP | 95305171. 1 | 2/1996 |
| EP | 98306471. 8 | 3/1999 |

*Primary Examiner*—Scott A Smith
*Assistant Examiner*—Nathaniel Chukwurah
(74) *Attorney, Agent, or Firm*—Harness, Dickey & Pierce, P.L.C.

(57) ABSTRACT

A power tool having a first housing assembly, an attachment post and a second housing assembly. The first housing assembly includes a motor assembly and a first wall member. The first wall member defines a first cavity having a longitudinal axis and terminates at a first abutting face. The attachment post has a longitudinal axis and is coupled to the first housing assembly such that the longitudinal axis of the attachment post is perpendicular to the longitudinal axis of the first cavity. The second housing assembly is coupled to the first housing assembly and includes a geartrain assembly, a second wall member and an attachment hook. The second wall member defines a second cavity which terminates at a second abutting face. The attachment hook has a slotted aperture with a longitudinal axis and first and second sidewalls.

29 Claims, 6 Drawing Sheets

MOTOR/HANDLE HOUSING AND GEAR CASE MOUNTING FOR PORTABLE POWER TOOL

This application claims the benefit of U.S. Provisional Application No. 60/164,899, filed Nov. 11, 1999.

BACKGROUND OF THE INVENTION

1. Technical Field

The present invention relates generally to power tools and more particularly to the construction of a housing for a power tool and a method for assembling a power tool.

2. Discussion

A common problem with power tools, particularly portable power tools of the pistol-grip or midhandle configuration having a "clam-shell" construction, concerns the region of the housing where the handle portion intersects the motor/geartrain portion that houses the motor and geartrain assemblies. Due to ergonomic concerns, the handle portion is typically narrower than the motor/geartrain portion to permit an operator to handle and manipulate the power tool in a comfortable manner. Considerations for the overall appearance of the power tool frequently prevent the intersection between the handle portion and the motor/geartrain portion from being strengthened sufficiently to prevent these portions from moving relative to one another when a force is applied to the housing, as when the power tool is dropped. Another drawback of the "clam shell" construction concerns the ability with which a power tool so constructed may be assembled. Typically, power tools having a "clam shell" construction are assembled in a process wherein the sub-components which form the tool are initially installed to a first clam shell half and thereafter a second clam shell half is coupled to the first clam shell half, securing the sub-components between the clam shell halves.

An often tedious and time-consuming operation in this process concerns the engagement an output member of a motor assembly with an input member of a geartrain assembly. Often it is necessary to move the motor assembly and geartrain relative to one another to engage the output and input members. Unfortunately, as the sub-components of the power tool are usually not fixedly secured to the first clam shell half, movement of the motor assembly and/or geartrain assembly frequently causes one or more sub-components to dislodge from the first clam shell half, thereby increasing the risk that a defective power tool will be produced.

SUMMARY OF THE INVENTION

It is therefore one object of the present invention to provide a power tool having improved resistance to breakage at an intersection between a handle portion and a motor/geartrain portion.

It is another object of the present invention to provide a power tool having a construction which moderates the difficulty with which a motor assembly and a geartrain assembly are meshingly engaged.

A power tool overcoming the above-mentioned drawbacks is provided herein. The power tool includes a first housing assembly, an attachment post and a second housing assembly. The first housing assembly includes a motor assembly and a first wall member. The first wall member defines a first cavity having a longitudinal axis and terminates at a first abutting face. The attachment post has a longitudinal axis and is coupled to the first housing assembly such that the longitudinal axis of the attachment post is perpendicular to the longitudinal axis of the first cavity. The second housing assembly is coupled to the first housing assembly and includes a geartrain assembly, a second wall member and an attachment hook. The second wall member defines a second cavity which terminates at a second abutting face. The attachment hook has a slotted aperture with a longitudinal axis and first and second sidewalls. The longitudinal axis of the slotted aperture is parallel to the longitudinal axis of the second cavity and the first and second sidewalls of the attachment hook slidably engaging the attachment post. The attachment hook and attachment post strengthen the power tool and are employed to align the first and second housing assemblies to one another, thus moderating the difficulty with which the motor assembly and the geartrain assembly are meshingly engaged with one another. Accordingly, a method for assembling a power tool is also provided.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
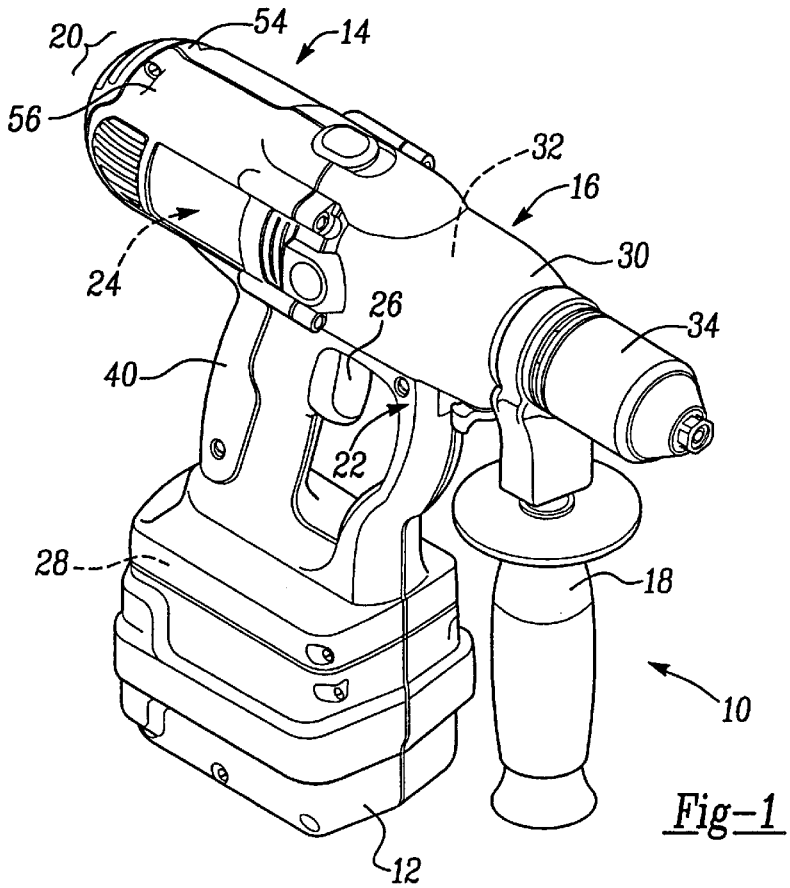
FIG. 1 is a perspective view of a power tool constructed in accordance with the teachings of the present invention.
Figure 2:
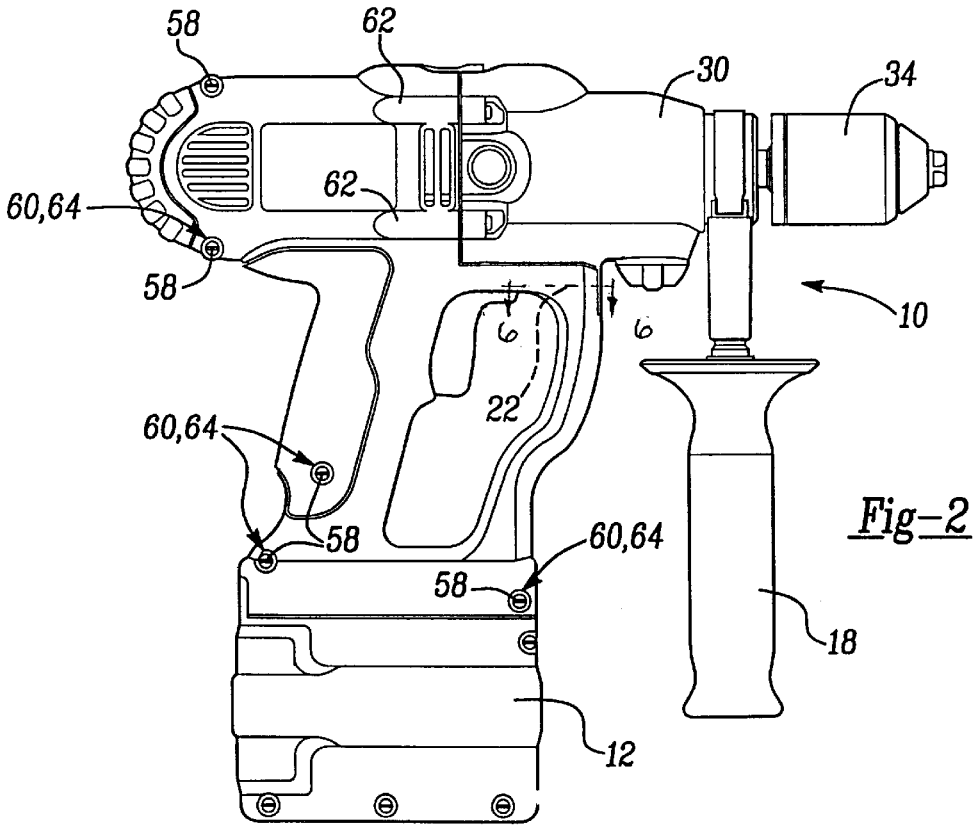
FIG. 2 is a side view of the power tool of FIG. 1.
Figure 3:
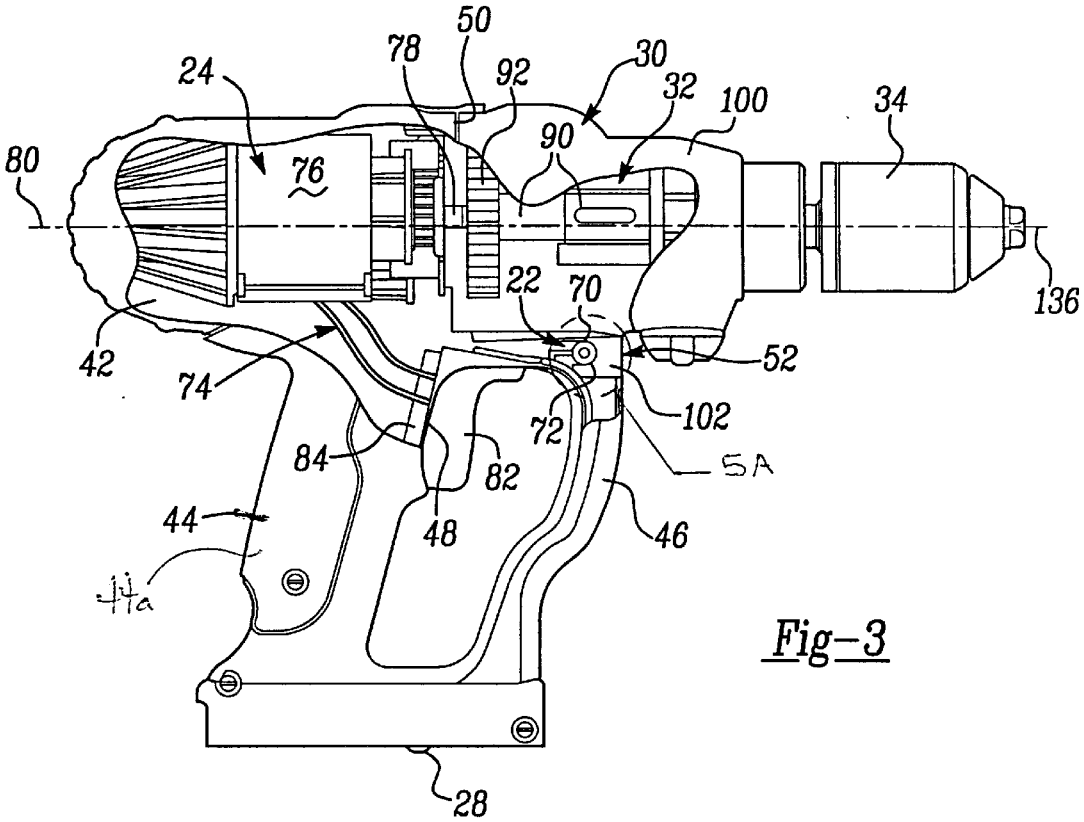
FIG. 3 is a partial cross-sectional view of the power tool of FIG. 1.
Figure 4A:
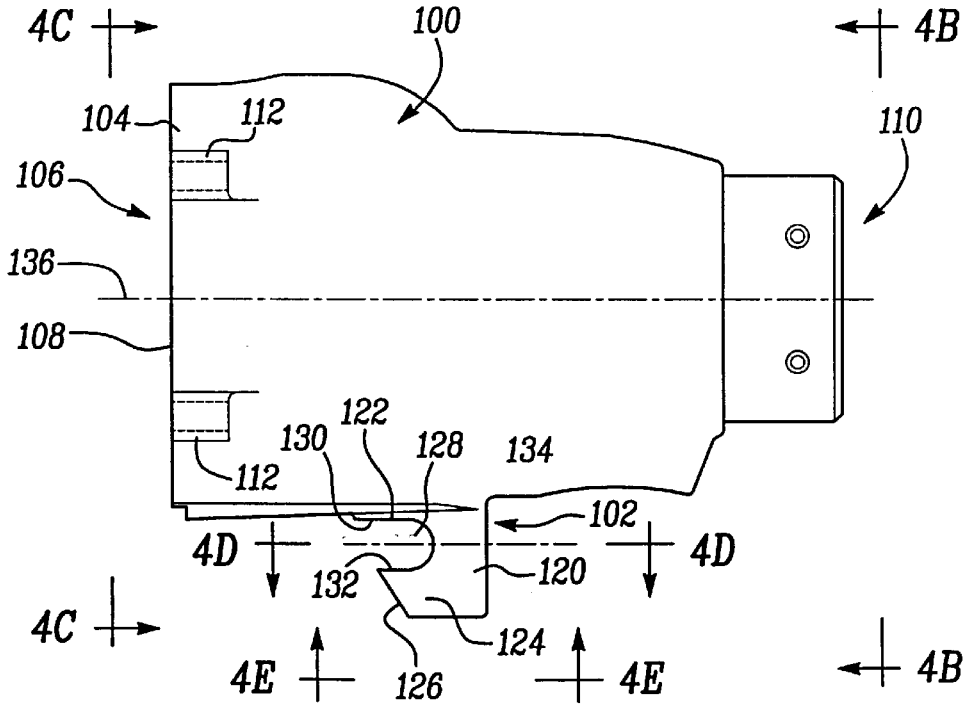
FIG. 4A is a side elevational view of a gear case constructed in accordance with a preferred embodiment of the present invention.
Figure 4B:
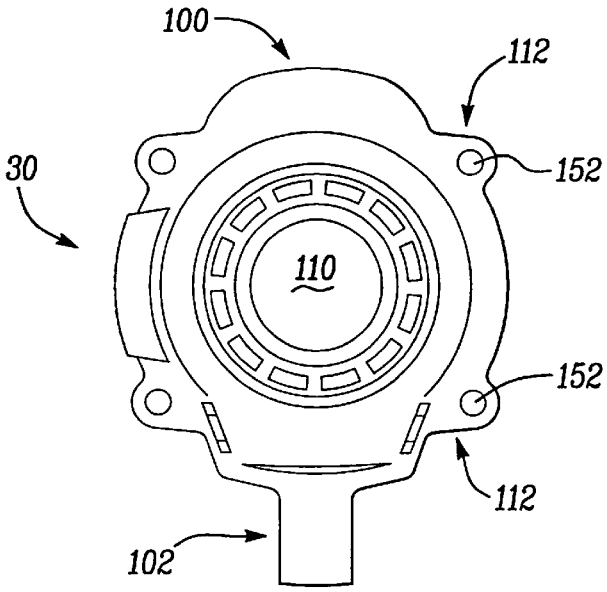
FIG. 4B is a front elevational view of the gear case of FIG. 4A.
Figure 4C:
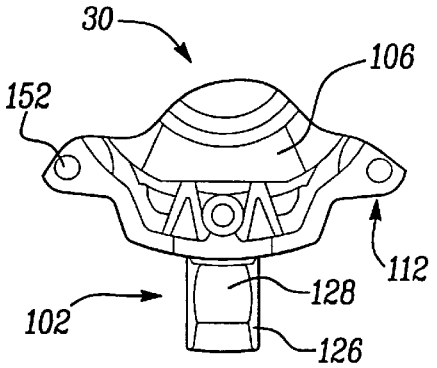
FIG. 4C is a rear elevational view of the gear case of FIG. 4A.
Figure 4D:
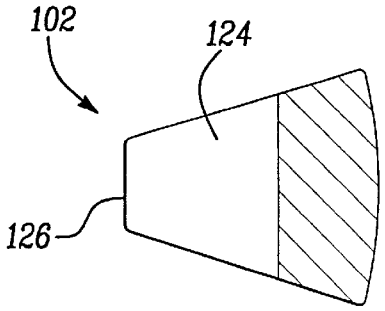
FIG. 4D is a fragmentary view of the attachment hook for the gear case taken along the line 4D—4D.
Figure 4E:
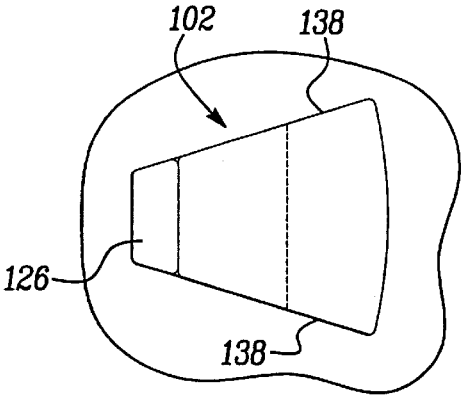
FIG. 4E is a fragmentary bottom elevational view of the gear case of FIG. 4A illustrating the attachment hook.

With reference to FIGS. 1 through 3 of the drawings, a power tool constructed in accordance with the teachings of the present invention is generally indicated by reference numeral 10. Tool 10 is illustrated as a cordless (i.e., battery operated) hammer drill. However, it will be understood that the teachings of the present invention have applicability to other types of power tools and as such, the present invention will not be limited in scope to either hammer drills or to cordless power tools.

Tool 10 is illustrated as including a battery pack 12, a first housing assembly 14, a second housing assembly 16 and an auxiliary handle 18. Battery pack 12 is conventional in construction and operation and need not be discussed in detail. Briefly, battery pack 12 clips to first housing assembly 14 and provide a source of stored electric power. First housing assembly 14 includes a first housing 20, an anchor or attachment post 22, a motor assembly 24, a trigger assembly 26 and a set of electrical contacts 28. Second housing assembly 16 is illustrated to include a gear case or second housing 30, a geartrain assembly 32 and a chuck 34.

First housing 20 includes a wall member 40 that defines a structure having a first cavity 42 and a handle portion 44. First housing 20 extends in a first generally fore-aft direction and preferably forms a rear portion of power tool 10. Handle portion 44 is illustrated to include a grip 44*a*, a hand guard portion 46, a trigger aperture 48, a first abutting surface 50 and an attachment hook aperture 52. Grip 44*a* is sized to permit a technician to comfortably operate and control tool 10. Hand guard portion 46 wraps around the forward side of handle portion 44 and terminates at a plane which approximately coincides with the bottom end of the first abutting surface 50. Attachment hook aperture 52 is formed in the forward surface of hand guard portion 46.

First housing 20 is preferably formed from first and second clam shell halves 54 and 56, respectively, and a plurality of threaded fasteners 58. Each of the first and second clam shell halves 54 and 56 are preferably formed from injection molded plastic and include a plurality of lateral screw bosses 60 and a plurality of longitudinal screw bosses 62. Each of the lateral and longitudinal screw bosses 60 and 62 include a screw aperture 64 for receiving a threaded fastener 58.

In the particular embodiment illustrated, attachment post 22 is a modified lateral screw boss which is formed into both the first and second clam shell halves 54 and 56. Attachment post 22 is illustrated to include first and second engagement surfaces 70 and 72 respectively. Alternatively, attachment post 22 may be separately constructed and thereafter coupled to first housing 20, with one possible construction of attachment post 22 being a shoulder bolt. Also alternatively, attachment post 22 may be formed into one of the first and second clam shell halves 54 and 56. In the particular embodiment illustrated, threaded fasteners 58 are placed in the plurality of lateral screw bosses 60 and the attachment post 22 and threaded into first clam shell half 54 to exert a clamping force which retains first and second clam shell halves 54 and 56 together.

Motor assembly includes a wire harness 74 and a motor 76 having an output member 78. Wire harness 74 electrically couples trigger assembly 26 and motor 76. Motor 76 is disposed within first cavity 42 such that the longitudinal axis of output member 78 is coincident with the longitudinal axis 80 of first cavity 42. In the particular embodiment illustrated, output member 78 extends forwardly of first abutting surface 50.

Trigger assembly 26 includes a trigger 82 and a switch 84. A second wire harness (not specifically shown) couples switch 84 to the set of electrical contacts 28. Trigger 82 extends through trigger aperture 48 to facilitate the actuation of trigger 82 in an efficient and ergonomic manner.

Geartrain assembly 32 is conventional in construction and operation and as such, a detailed description need not be provided herein. Briefly, geartrain assembly 32 includes a plurality of gear members 90 including an input member 92 and a geartrain output member (not specifically shown). Torque input to input member 92 is multiplied by the plurality of gear members 90 and output to the geartrain output member. Preferably, geartrain assembly 32 is modular in construction to permit it to be subassembled and then installed to second housing 30. Chuck 34 is also conventional in its construction and operation and is fixedly but releasably coupled to the geartrain output member.

Second housing 30 extends in a second generally fore-aft direction parallel the first direction. Second housing 30 is preferably unitarily formed from a metal or a molded plastic material and forms a front portion of power tool 10. In the particular embodiment illustrated, second housing 30 is a die cast magnesium component. With reference to FIGS. 4A through 4D, second housing 30 is illustrated to include a housing portion 100 and an attachment hook 102. Housing portion 100 includes a wall member 104 that defines structure having a second cavity 106, a second abutting surface 108, an output aperture 110 and a plurality of longitudinal screw bosses 112. Second cavity 106 is sized to receive geartrain assembly 32. Output aperture 110 is sized to receive the geartrain output member.

In the particular embodiment illustrated, attachment hook 102 is generally U-shaped having a base member 120 juxtaposed with an upper leg member 122 on one side and a lower leg member 124 on another side. Upper leg member 122 is fixedly coupled to the bottom side of housing portion 100 forwardly of second abutting surface 108. Base member 120 is fixedly coupled to and extends perpendicularly downwardly from upper leg member 122. Lower leg member 124 is fixedly coupled to base member 120 and extends rearwardly therefrom. A tapered leading edge 126 which tapers in a downwardly and forwardly direction is formed into the rearward edge of lower leg member 124. Base member 120 and upper and lower leg members 122 and 124 cooperate to form a slotted aperture 128 having first and second sidewalls 130 and 132, respectively. The axis 134 of slotted aperture 128 is parallel to and offset from the axis 136 of second cavity 106. Preferably, the sides 138 of attachment hook 102 taper inwardly and rearwardly toward the axis 134 of slotted aperture 128 from the front of attachment hook 102 to its rear.

Figure 5A:
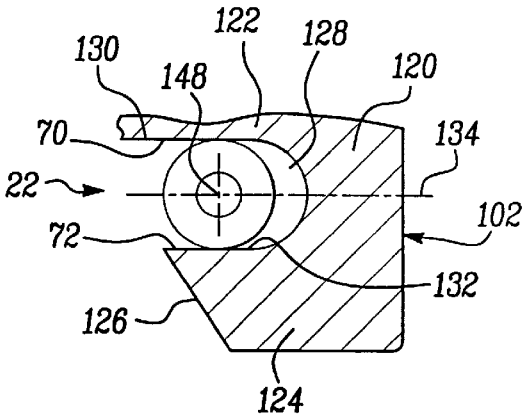
FIG. 5A is an enlarged fragmentary view of the attachment hook and attachment post illustrated in FIG. 3.

Referring back to FIG. 3 and with additional reference to FIG. 5A, attachment hook 102 is operatively engaged to attachment post 22. Upper and lower leg members 122 and 124 are illustrated to abut attachment post 22 such that first and second sidewalls 130 and 132 adjoin first and second engagement surfaces 70 and 72, respectively. The longitudinal axis 148 of attachment post 22 is shown to be approximately perpendicular to the axis 136 of second cavity 106.

In FIGS. 5A through 5E, various embodiments of the attachment hook 102 and the attachment post 22 are illustrated. A preferred embodiment is illustrated in FIG. 5A, wherein the first and second sidewalls 130 and 132 are parallel one another and contact the first and second engagement surfaces 70 and 72, respectively. In this regard, the diameter of attachment post 22 is approximately equal to the width of hook aperture 128.. With brief additional reference to FIG. 6, engagement of attachment hook 102 to attachment post 22 causes the inwardly rearwardly tapering sides 138 of attachment hook 102 to abut the inwardly rearwardly tapering sides 140 of attachment hook aperture 52 and lock the first and second housings 20 and 30 together, both vertically and laterally.

Figure 5B:
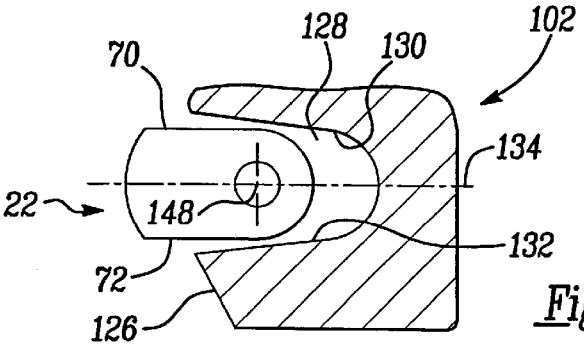
FIG. 5B is a view similar to FIG. 5A but illustrating an attachment hook and an attachment post constructed in accordance with a first alternate embodiment of the present invention.
Figure 5C:
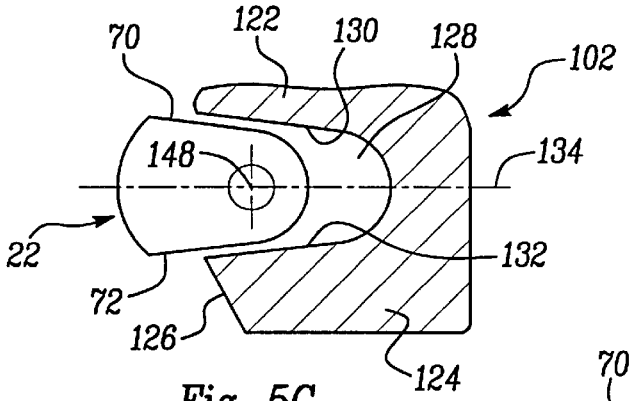
FIG. 5C is a view similar to FIG. 5A but illustrating an attachment hook and an attachment post constructed in accordance with a second alternate embodiment of the present invention.
Figure 5D:
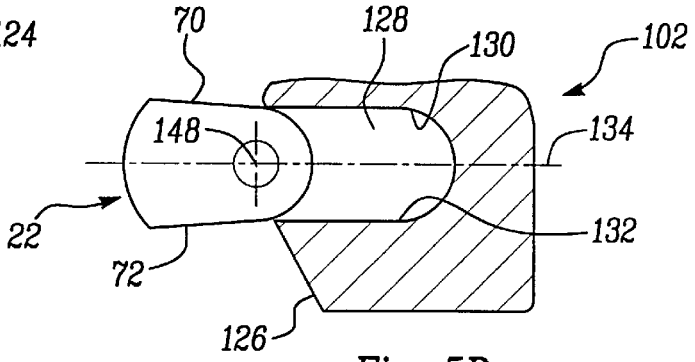
FIG. 5D is a view similar to FIG. 5A but illustrating an attachment hook and an attachment post constructed in accordance with a third alternate embodiment of the present invention.
Figure 5E:
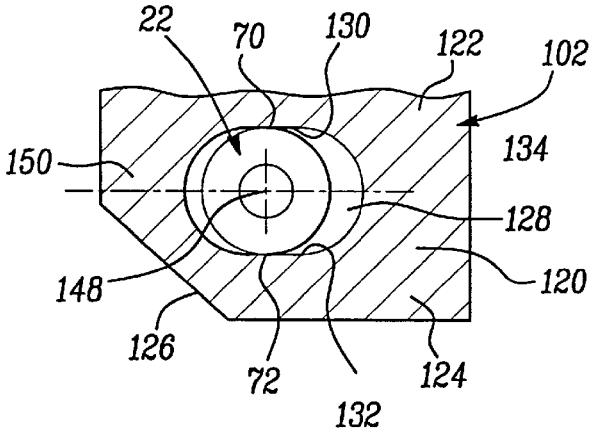
FIG. 5E is a view similar to FIG. 5A but illustrating an attachment hook and an attachment post constructed in accordance with a fourth alternate embodiment of the present invention.
Figure 6:
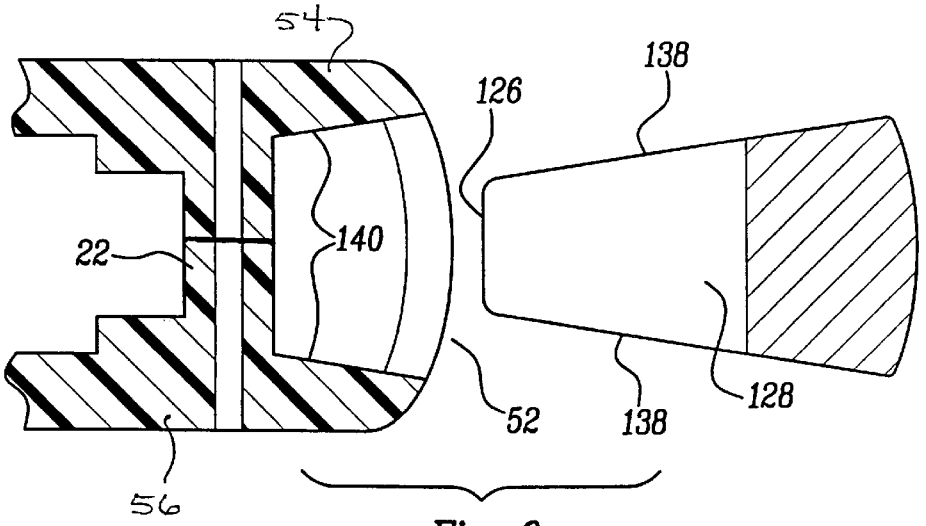
FIG. 6 is a partial sectional view taken along the line 6—6 of FIG. 2 illustrating the inwardly rearwardly tapered sides of the attachment hook exploded away from the inwardly rearwardly tapered sides of the first housing assembly.

A first alternate embodiment is illustrated in FIG. 5B, wherein the first and second engagement surfaces 70 and 72 of attachment post 22 are parallel one another and the first and second sidewalls 130 and 132 are illustrated to taper inwardly toward the axis 134 of slotted aperture 128. A second alternate embodiment is illustrated in FIG. 5C, wherein the configuration of the first and second sidewalls 130 and 132 is identical to the configuration of FIG. 5B, but the first and second engagement surfaces 70 and 72 are illustrated to taper inwardly to an axis perpendicular to the axis 148 of attachment post 22 and parallel the axis 136 of second cavity 106 (i.e., an axis which coincides with the axis 134 of slotted aperture 128). A third alternate embodiment is illustrated in FIG. 5D, wherein the configuration of the first and second engagement surfaces 70 and 72 is identical to that of FIG. 5C (i.e., the first and second engagement surfaces 70 and 72 taper inwardly toward an axis perpendicular to the axis 148 of attachment post 22), but the configuration of the first and second sidewalls 130 and 132 is identical to that of FIG. 5A (i.e., the first and second sidewalls 130 and 132 are parallel one another). A fourth alternate embodiment is illustrated in FIG. 5E, which is similar to the embodiment illustrated in FIG. 5A except that attachment hook 102 includes a rear member 150 that couples the rear edges of upper and lower leg members 122 and 124 together to close the rearward end of slotted aperture 128 such that attachment hook 102 is hoop-shaped.

Returning to FIG. 3, the first and second abutting surfaces 50 and 108 are illustrated to adjoin one another. However, gaskets or seals (not shown) may be included between the first and second abutting surfaces 50 and 108 to prevent fluids or lubricants from leaking from the first and second cavities 42 and 106. Fasteners 58 are introduced to the screw apertures 152 of the longitudinal screw bosses 62 and tightened to fixedly but releasably join first and second housing assemblies 14 and 16 together. Attachment hook 102 and attachment post 22 cooperate to stiffen the area of tool 10 proximate the upper end of handle portion 40 and hand guard portion 46, thereby increasing the durability of tool 10 and its resistance to breakage from impacts.

Advantageously, construction of tool 10 in accordance with the teachings of the present invention also improves the ability with which a power tool may be assembled. Construction of attachment hook 102 in accordance with the preferred embodiment of the present invention permits the first and second housing assemblies 14 and 16 to be completely subassembled prior to their mating. Preassembly eliminates the risk that any of the components forming the first housing assembly 14 will be dislodged during the mating of the motor assembly 24 and the geartrain assembly 32.

Figure 7:
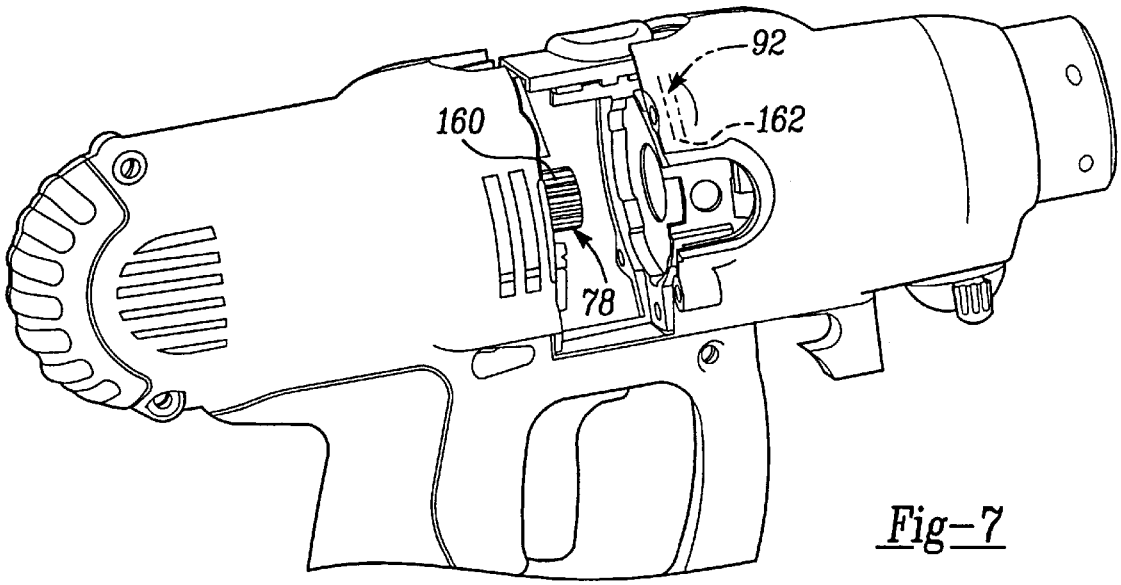
FIG. 7 is a perspective view of the power tool of FIG. 1, illustrating the assembly of the first and second housing assemblies.
Figure 8A:
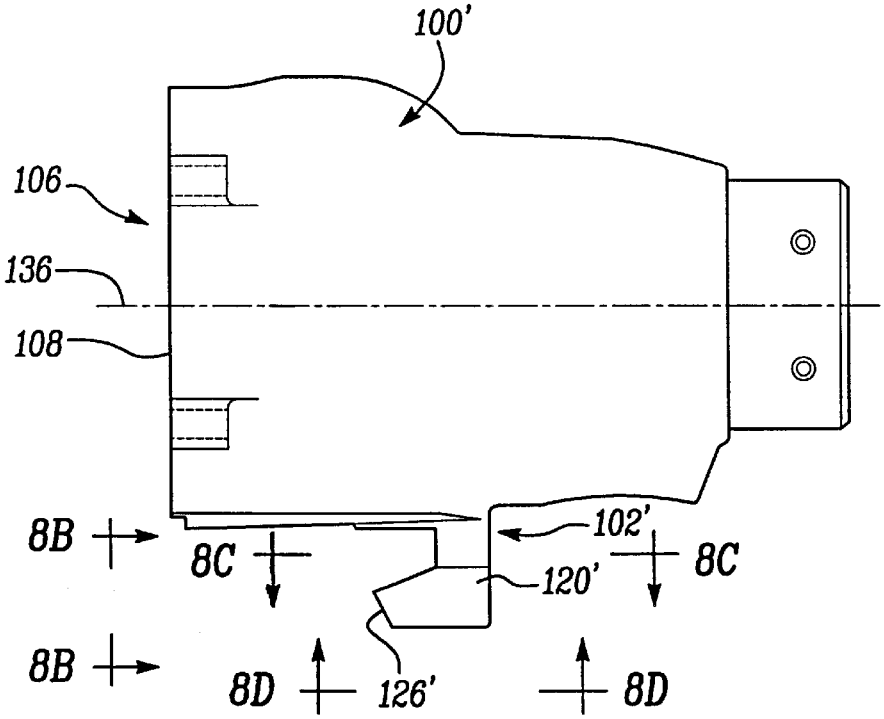
FIG. 8A is a side elevational view of a gear case constructed in accordance with an alternate embodiment of the present invention.
Figure 8B:
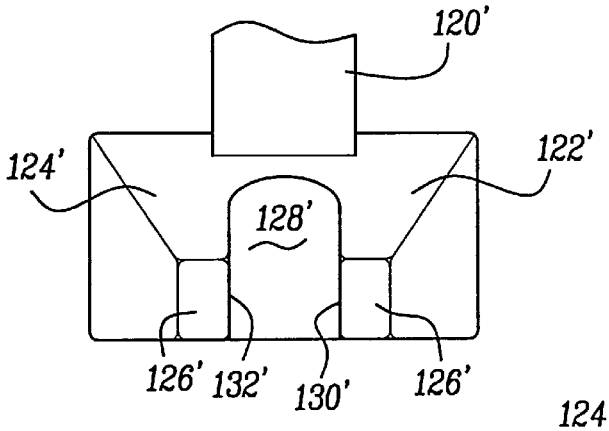
FIG. 8B is a fragmentary rear elevational view of the gear case of FIG. 8A.
Figure 8C:
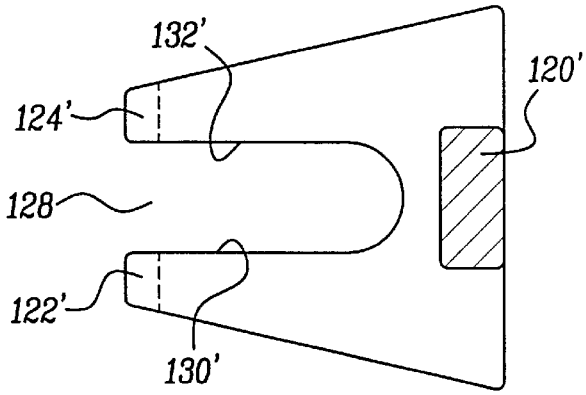
FIG. 8C is a sectional view taken along the line 8C—8C of FIG. 8A.
Figure 8D:
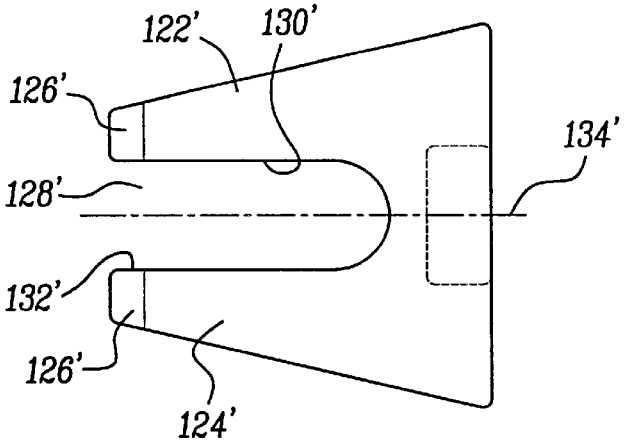
FIG. 8D is a fragmentary bottom elevational view of the gear case of FIG. 8A illustrating the attachment hook.

Furthermore, attachment hook 102 and attachment post 22 may be employed to guide first and second housing assemblies 14 and 16 during their mating. Engagement of attachment hook 102 to attachment post 22 permits the axis 80 of the first cavity 42 to be precisely aligned with the axis 136 of the second cavity 106. Alignment of axes 80 and 136 with one another simultaneously aligns output member 78 to input member 92 and thus greatly moderates the difficulty with which motor assembly 24 and geartrain assembly 32 are meshingly engaged. Also advantageously, the tapered sides 138 of attachment hook 102 permit second housing assembly 16 to be shifted from side to side (but not vertically from top to bottom) as it is being coupled to first housing assembly 14 when the attachment hook 102 has not fully engaged the attachment post 22. This flexibility greatly aids in the engagement of motor assembly 24 to geartrain assembly 32, permitting output member 78, such as pinion 160, to be pushed into engagement with input member 92, such as first stage planetary gear 162, as shown in FIG. 7.

Assembly of the first and second housing assemblies 14 and 16 is completed by sliding first and second housing assemblies 14 and 16 together and rotating either input member 92 or output member 78 as necessary to meshingly engage motor assembly 24 and geartrain assembly 32. Input member 92 may be rotated by rotating the geartrain output member or chuck 34. Once input member 92 and output member 78 have been engaged, first and second housing assemblies 14 and 16 cannot be shifted significantly from top to bottom as a result of the contact between attachment post 22 and attachment hook 102. First and second abutting surfaces 50 and 108 are thereafter brought into contact and fasteners 58 are thereafter employed to retain first and second housing assemblies 14 and 16 together as discussed above.

Construction of a power tool in accordance with the embodiment illustrated in FIG. 5E does not permit the first housing assembly 14 to be preassembled. However, attachment hook 102 and attachment post 22 may be employed in the manner described above to align the input member 92 and the output member 78 to meshingly engage motor assembly 24 and geartrain assembly 32.

While the attachment hook of the present invention has been described thus far as being oriented in a generally horizontal attitude, those skilled in the art will appreciate that the invention, in its broader aspects, may be constructed somewhat differently. For example, the attachment hook 102' may be formed as shown in FIGS. 8A through 8D and 9.

In the particular embodiment illustrated, attachment hook 102' is generally U-shaped having a base member 120' juxtaposed with a first leg member 122' on one side and a second leg member 124' on another side. Base member 120' is fixedly coupled to the bottom side of housing portion 100' forwardly of second abutting surface 108. First and second leg members 122' and 124' are fixedly coupled to and extend perpendicularly rearwardly from base leg member 120'. A tapered leading edge 126 which tapers in a downwardly and forwardly direction is formed into the rearward edges of first and second leg member 122' and 124'. First and second leg members 122' and 124' cooperate to form a vertically slotted aperture 128' having first and second sidewalls 130' and 132', respectively. The axis 134' of slotted aperture 128' is parallel to and offset from the axis 136 of second cavity 106. Preferably, the outboard sides 138' of attachment hook 102' taper inwardly rearwardly toward the axis 134' of slotted aperture 128' from the front of attachment hook 102' to its rear.

Figure 9:
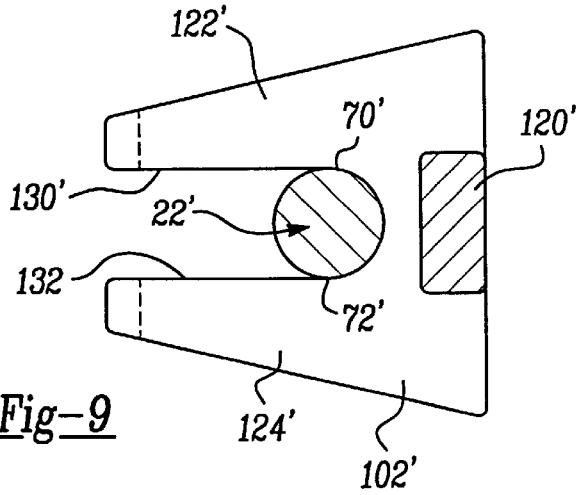
FIG. 9 a partial sectional view through a power tool constructed in accordance with an alternate embodiment of the present invention illustrating the connection between the attachment post and the attachment hook.

In FIG. 9, the assembly of the first and second housing assemblies is illustrated. Attachment hook 102' operatively engages vertically oriented attachment post 22' which is similar in construction to attachment post 22 but oriented in a vertical manner. First and second leg members 122' and 124' are designed to abut attachment post 22' such that first and second sidewalls 130' and 132' adjoin the first and second engagement surfaces 70' and 72', respectively.

While the invention has been described in the specification and illustrated in the drawings with reference to a preferred embodiment and several alternate embodiments, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

We claim:

1. A power tool comprising:

a first housing having a first wall member, the first wall member defining a first cavity with a longitudinal axis, the first cavity terminating at a first abutting face;

an attachment post having a longitudinal axis and first and second engagement surfaces, the attachment post coupled to the first housing such that the longitudinal axis of the attachment post is perpendicular to the longitudinal axis of the first cavity; and a second housing coupled to the first housing, the second housing having a second wall member and an attachment hook, the second wall member defining a second cavity, the second cavity terminating at a second abutting face, the attachment hook having a slotted aperture with a longitudinal axis and first and second sidewalls, the longitudinal axis of the slotted aperture being parallel to the longitudinal axis of the second cavity, the first and second sidewalls of the attachment hook engaging the first and second engagement surfaces, respectively.

2. The power tool of claim 1, wherein the first housing is defined by a pair of mating housing shells.

3. The power tool of claim 2, wherein the attachment post is a screw boss which is molded into at least one of the pair of mating housing shells.

4. The power tool of claim 1, wherein the first housing further includes a trigger aperture adapted for housing a trigger mechanism for controlling the power tool and the attachment post is coupled to the first housing forwardly of the trigger aperture.

5. The power tool of claim 1, wherein at least one of the first and second sidewalls tapers inwardly toward the longitudinal axis of the slotted aperture.

6. The power tool of claim 5, wherein the attachment post includes an exterior surface which tapers inwardly toward an axis perpendicular to a longitudinal axis of the attachment post.

7. The power tool of claim 1, wherein the attachment hook includes a tapered leading edge.

8. The power tool of claim 1, wherein the slotted aperture is generally U-shaped.

9. The power tool of claim 1, wherein the first cavity adapted to receive a motor assembly and the second cavity is adapted to receive a geartrain assembly.

10. A method for assembling a power tool comprising the steps of:

providing a first assembly having a motor assembly, an attachment post and a first housing, the first housing having a first wall member defining a first cavity with a longitudinal axis, the first cavity terminating at a first abutting surface, the attachment post having a longitudinal axis and coupled to the first wall member such that the longitudinal axis of the attachment post is perpendicular to the longitudinal axis of the first cavity, the first motor assembly having a motor with an output member, the first motor assembly at least partially disposed within the first cavity;

providing a second assembly having a second housing and a geartrain assembly, the second housing having a second wall member and an attachment hook, the second wall member defining a second cavity, the second cavity terminating at a second abutting surface and receiving the geartrain assembly, the attachment hook having a slotted aperture with a longitudinal axis and first and second sidewalls, the longitudinal axis of the slotted aperture offset from and parallel to the longitudinal axis of the second cavity, the geartrain assembly including an input member;

aligning the attachment hook and the attachment post to one another such that at least a portion of the attachment post is disposed within the slotted aperture;

aligning the first and second assemblies such that the longitudinal axis of the first cavity coincides with the longitudinal axis of the second cavity; and mating the first and second assemblies together.

11. The method of claim 10, wherein the step of mating the first and second assemblies together includes the steps of:

sliding the first and second assemblies toward one another along the longitudinal axis of the second cavity; and meshingly engaging the motor assembly and the geartrain assembly.

12. The method of claim 11, wherein the step of meshingly engaging the motor assembly and the geartrain assembly includes the steps of:

rotating the input member of the geartrain assembly; and sliding the first and second assemblies together along the longitudinal axis of the second cavity.

13. The method of claim 10, wherein the step of providing the first assembly includes the steps of:

providing a first housing shell having a first member defining a first portion of the first cavity;

providing a motor assembly;

installing the motor assembly to the first portion of the first cavity;

providing a second housing shell having a second member defining a second portion of the first cavity; and coupling the second housing shell to the first housing shell.

14. A method for assembling a power tool comprising the steps of:

providing a portion of a first assembly having a first housing shell, a motor assembly and an attachment post, the first housing shell including a first member defining a first portion of a first cavity, the motor assembly having a motor with an output member, the motor at least partially disposed in the first portion of the first cavity, the attachment post coupled to the first member such that a longitudinal axis of the attachment post is perpendicular to a longitudinal axis of the first cavity;

providing a second assembly having a second housing and a geartrain assembly, the second housing having a second wall member and an attachment hook, the second wall member defining a second cavity, the second cavity terminating at a second abutting face and receiving the geartrain assembly, the attachment hook having a slotted aperture with a longitudinal axis and first and second sidewalls, the geartrain assembly including an input member, the longitudinal axis of the slotted aperture offset from and parallel to the longitudinal axis of the second cavity;

aligning the attachment hook and the attachment post to one another such that the attachment post is disposed within the slotted aperture;

aligning the first portion of the first assembly and second assembly such that the longitudinal axis of the first portion of the first cavity coincides with the longitudinal axis of the second cavity; and mating the first portion of the first assembly and the second assembly together.

15. The method of claim 14, wherein the step of providing the portion of a first assembly includes the steps of:

providing a portion of a first housing having a first housing shell with a first member defining a first portion of a first cavity;

providing a motor assembly having a motor with an output member; and installing the motor assembly to the first housing portion such that the motor is at least partially disposed in the first portion of the first cavity.

16. The method of claim 14, further comprising the steps of:

providing a second housing shell having a second member defining a second portion of the first cavity; and coupling the second housing shell to the first housing shell to encase said motor in said first cavity.

17. The method of claim 14, wherein the step of mating the first portion of the first assembly and the second assembly together includes the steps of:

sliding the first portion of the first assembly and second assembly toward one another along the longitudinal axis of the second cavity; and meshingly engaging the motor assembly and the geartrain assembly.

18. The method of claim 17, wherein the step of meshingly engaging the motor assembly and the geartrain assembly includes the steps of:

rotating an input member of the geartrain assembly; and sliding the first portion of the first assembly and second assembly together along the longitudinal axis of the second cavity.

19. A gearcase for a power tool comprising:

a wall member defining a cavity adapted for receiving a geartrain assembly, the cavity terminating at an abutting face; and an attachment hook coupled to the wall member, the attachment member having a slotted aperture with a longitudinal axis and first and second sidewalls, the longitudinal axis of the slotted aperture parallel to the longitudinal axis of the cavity, the first and second sidewalls of the attachment hook adapted to engage an attachment post.

20. The gearcase of claim 19, wherein at least one of the first and second sidewalls tapers inwardly toward the longitudinal axis of the slotted aperture.

21. The gearcase of claim 19, wherein the slotted aperture is generally U-shaped.

22. A power tool comprising:

a motor housing having a first cavity extending in a first direction and a handle extending generally transverse to the first direction;

a motor disposed in the first cavity of the first housing;

a gear case connected to the motor housing and having a second cavity extending generally in a second direction parallel to the first direction;

a gear train disposed in the gear case;

the handle having an anchor; and the gear case having a hook engaged with the anchor.

23. The power tool of claim 22, wherein:

the motor housing and the gear case extend generally in a fore-and-aft direction parallel with the first and second directions;

the gear case forms the front of the tool;

the handle has an opening having lateral sidewalls and receiving the hook;

the lateral sidewalls of the opening taper inwardly rearwardly; and the hook has rearwardly inwardly tapering sidewalls mating the sidewalls of the opening.

24. The power tool of claim 23, wherein:

the hook has an aperture with forwardly inwardly tapering surfaces engaged with the anchor; and the tapered surfaces of the aperture are offset about 90 degrees from the tapered sidewalls of the hook.

25. The power tool of claim 22, wherein:

the handle has a grip and a guard; and the anchor is formed on the guard and extends generally transverse to the fore and aft direction.

26. The power tool of claim 22 wherein the hook is a closed loop defining a central opening for receiving the anchor.

27. The power tool of claim 22, wherein the gear train is modular.

28. The power tool of claim 22 wherein:

the motor housing is formed by a pair of clam shells; and the gear case is unitarily formed.

29. The power tool of claim 22, wherein:

the handle has a rearwardly and inwardly tapering opening; and the hook is a rearwardly inwardly tapering pyramid mating with the opening in the handle.

* * * * *

UNITED STATES PATENT AND TRADEMARK OFFICE

CERTIFICATE OF CORRECTION

PATENT NO. : 6,446,734 B1 
DATED : September 10, 2002
INVENTOR(S) : Robert B. Williams et al.

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 3,876,015 | 4/1975 | Kivela |
| 4,251,120 | 2/1981 | Wolff |
| 4,728,876 | 3/1988 | Mongeon et al |
| 5,553,675 | 9/1996 | Pitzen et al |
| 6,321,856 | 11/2001 | Alsruhe --; and |

"5,033,550" should be -- 5,033,552 --.

Column 10,
Line 6, "member" should be -- hook --.

Signed and Sealed this

Thirtieth Day of December, 2003

JAMES E. ROGAN
*Director of the United States Patent and Trademark Office*